US008253316B2

(12) United States Patent
Sun et al.

(10) Patent No.: US 8,253,316 B2
(45) Date of Patent: Aug. 28, 2012

(54) DIMMABLE LED LAMP

(75) Inventors: Yupin Sun, Yorba Linda, CA (US); Waqidi Falicoff, Stevenson Ranch, CA (US); Will Shatford, Pasadena, CA (US)

(73) Assignee: Light Prescriptions Innovators, LLC, Altadena, CA (US)

( * ) Notice: Subject to any disclaimer, the term of this patent is extended or adjusted under 35 U.S.C. 154(b) by 290 days.

(21) Appl. No.: 12/778,231

(22) Filed: May 12, 2010

(65) Prior Publication Data

US 2010/0289395 A1 Nov. 18, 2010

Related U.S. Application Data

(60) Provisional application No. 61/216,182, filed on May 13, 2009.

(51) Int. Cl.
*H01J 1/62* (2006.01)
*H01J 63/04* (2006.01)

(52) U.S. Cl. ..... 313/483; 313/501; 362/84

(58) Field of Classification Search ..... 313/483, 313/500, 502; 257/98; 362/84, 231, 249.02, 362/555, 311.02
See application file for complete search history.

(56) References Cited

U.S. PATENT DOCUMENTS

| | | | | |
|---|---|---|---|---|
| 2008/0013316 | A1 | 1/2008 | Chiang | 362/264 |
| 2009/0067179 | A1 * | 3/2009 | Chaves et al. | 362/329 |
| 2009/0225529 | A1 * | 9/2009 | Falicoff et al. | 362/84 |
| 2010/0208488 | A1 * | 8/2010 | Luo | 362/555 |

FOREIGN PATENT DOCUMENTS

| | | | |
|---|---|---|---|
| JP | 2004-193049 | A | 7/2004 |
| KR | 10-2005-0029384 | A | 3/2005 |
| KR | 10-2005-0090707 | A | 9/2005 |
| WO | WO 2006/001928 | A1 | 1/2006 |

* cited by examiner

*Primary Examiner* — Mariceli Santiago
*Assistant Examiner* — Glenn Zimmerman
(74) *Attorney, Agent, or Firm* — Drinker Biddle & Reath LLP

(57) ABSTRACT

An LED-powered replacement for the conventional incandescent screw-in light bulb comprises a phosphor coated sphere emitting white light into the same spherical pattern as a frosted incandescent bulb. In one embodiment inside the hollow sphere there is a dielectric cone emitting blue light, which causes the phosphor coating to glow. The blue light comes into the cone from a dielectric totally internally reflecting concentrator (DTIRC), which receives light from a conical reflector surrounding an LED array. The array has blue chips for energizing the phosphor and red chips for supplementing the phosphor light, enabling separate electronic control of the color temperature as well as the overall luminosity of the LED Lamp. Both blue and red chips are controlled by a quantum dimmer.

17 Claims, 3 Drawing Sheets

DIMMABLE LED LAMP

CROSS REFERENCE TO RELATED APPLICATIONS

This application claims benefit of U.S. Provisional Patent Application No. 61/216,182, filed May 13, 2009 by Sun et al. for "Dimmable LED Lamp."

This application is related to commonly owned co-pending U.S. patent application Ser. No. 12/378,666 (publication no. 2009-0225529), filed Feb. 18, 2009 by Falicoff et al. for "Spherically emitting remote phosphor"; co-pending U.S. patent application Ser. No. 12/589,071 (publication no. 2010-0097002), filed Oct. 16, 2009 by Shatford et al. for "Quantum Dimming via Sequential Stepped Modulation of LED Arrays"; co-pending U.S. patent application Ser. No. 12/687,620, filed Jan. 14, 2010 by Falicoff et al. for "Heat sink with helical fins and Electrostatic Augmentation"; co-pending U.S. patent application Ser. No. 12/210,096 (publication no. 2009-0067179) filed Sep. 12, 2008 by Chaves et al. for "Optical Device for LED-Based Lamp"; U.S. Pat. No. 7,144,121 issued Dec. 5, 2006 to Miñano et al. for "Dichroic Beam Combiner Utilizing Blue LED with Green Phosphor"; and U.S. Pat. No. 7,286,296 issued Oct. 23, 2007 and No. 7,380,962 issued Jun. 3, 2008, both to Chaves, Falicoff et al. for "Optical Manifolds for Light Emitting Diodes." All of the above patents and applications, together with any earlier provisional applications to which any of them relates, are incorporated herein by reference in their entirety.

BACKGROUND OF THE INVENTION

Conventional incandescent lamps have an efficacy of 10 to 12 lumens per watt, so that a 60 W incandescent lamp (a common wattage) has a flux output of 600 to 720 lumens. In addition, the color temperature of these lamps is under 3000° K and they achieve a color rendering index (CRI) near 100. It would be desirable to have a retro-fit high efficiency solid state lamp that can replace a 60 to 75 W incandescent lamp, and that has a similar color temperature and a high CRI (above 85 and preferably 90 or more). Also, it would be desirable if the solid state lamp was dimmable (a major problem with the vast majority of the compact fluorescent bulbs that are at present the commonest substitutes for incandescent bulbs.) Finally, it would be desirable if the output from this solid state lamp replicate the spherical output from incandescent sources. Such a solid state device is especially needed at this time, because the European Union (EU) and the USA have mandated that incandescent lamp will be phased out in the near future (2010 for the EU). Current solid state replacement lamps are typically limited to a flux of around 400 to 480 lumens (equivalent to the flux output of a 40 W incandescent bulb), primarily because of thermal management issues. Also, the light output from these lamps does not match the spherical output from filament-based sources.

SUMMARY OF THE INVENTION

With embodiments of the lamps described herein, it is believed to be possible to meet all the aforementioned goals to at least some extent.

Embodiments of the present lamps make it possible to overcome the above mentioned thermal limitation by employing the helical vane cooling system described in the above-mentioned U.S. patent application Ser. No. 12/687,620. The invention also employs optical features taught in the above-mentioned U.S. patent application Ser. Nos. 12/210,096 and 12/378,666. These novel optical approaches provide solutions that make it possible to produce a spherical light output similar to that from an incandescent filament in a relatively small package. Embodiments of the present lamps make use of the driver and dimming systems taught in the above-mentioned U.S. patent application Ser. No. 12/589,071.

It is also desirable for the LED lamp to have a very high efficiency. This can be achieved using the approach known as "remote phosphor" taught in the above-mentioned U.S. Pat. Nos. 7,286,296 and 7,380,962. A further principle used in the present lamps to achieve high efficiency is to combine the output from blue LEDs, blue stimulated yellow or green phosphor, and red LEDs. Such a system can achieve high efficiencies without compromising the CRI of the source. This approach to achieving high efficiency was taught in the above-mentioned U.S. Pat. No. 7,144,121. In that patent the outputs from blue LEDs, green phosphor and red LEDs are combined via a dichroic mirror after first being collimated. In embodiments of the present lamps, the output from these three light sources is combined in a spherical phosphor mixing chamber. Embodiments of the present lamps have in common with the devices of U.S. Pat. No. 7,144,121 that the red light is first collimated but differ in that the blue light source is first collimated on its own and then concentrated and sent into a spherical mixing chamber. A portion of the blue light is used to excite the remote phosphor while the remainder escapes through the phosphor. (A small portion of this light is reflected back to the LEDs.) The phosphor layer, which acts as a homogenizer, may reside on the inside of a hollow glass or other transparent or translucent dielectric sphere or alternatively may reside on the outside of a solid or hollow dielectric sphere. In U.S. Pat. No. 7,144,121 the green phosphor is proximate to the blue LED light source, and the combined blue/green light is collimated. Embodiments of the present lamps have an advantage in that the phosphor mixing chamber both homogenizes the three wavelength sources and outputs the desired spherical beam output profile to emulate a filament source.

In order to achieve a high CRI it is useful to employ the approach taught in U.S. Pat. No. 7,144,121 where the white light is created by a combination of blue, green/yellow and red light sources. Experiments carried out by the Inventors showed that a system that uses this approach to make white light can achieve a CRI above 90 and a system efficacy from 60 to 100 lumens per watt using currently available LED chips and phosphors.

Because of the thermal challenges of being confined to the volumetric envelope of a conventional incandescent lamp, the success of an LED substitute is as dependent upon the effectiveness of its heat-removal system as it is dependent upon the effectiveness of its optics or electronics. The present application describes embodiments of a complete dimmable LED lamp system, including helical fins enabling the LED light source to operate at much higher power levels than conventional LED lamp substitutes. Embodiments of the system include an array of red and blue LEDs mounted on a common board, which in turn has thermal vias connected to the helical vane thermal management system. This passive thermal system is configured to create an air current that cools the vanes over a wide range of orientations. This makes it possible to construct a device suitable as a replacement for A19 and other incandescent lamps. The prior art approach for solid state lamps is to use vertical or horizontal fins, which operate well only for certain orientations (for example, vertical fins orientated vertically).

In order to achieve the highest efficacy and CRI, embodiments of the lamp produce white light by combining the output of the blue and red LEDs with green or yellow light from a remote phosphor source. A portion of the blue light is used to excite the phosphor. In an embodiment, the phosphor is remote from the LEDs and resides on the inside surface of a glass sphere at the exit aperture of an optical transfer system. Alternatively, the phosphor can reside on the outside of a solid dielectric sphere. In this embodiment the phosphor is usually protected, either by its being immersed in a suitable material, such as epoxy, or by a covering.

The optical transfer system in these embodiments can consist of an open reflector and a solid dielectric optic. In an embodiment, the solid dielectric optic has both active and inactive surfaces. In general, an active surface is a surface that is contacted by light rays and guides the light, for example, by reflecting or refracting light rays, while an inactive surface is a surface that is not contacted by a significant proportion of light that will contribute to the light output of the lamp. The inactive surface or surfaces can provide a site for a feature used to hold and align the optic with respect to the LED array. A first active surface of this optic is a convex lens. The angular divergence of the light from the open reflector is reduced upon entering the convex lens. Light is transferred through the solid dielectric optic by a combination of TIR and direct radiation. In one embodiment there is a solid dielectric conical ejection feature at the end of the solid dielectric optic. In another embodiment there is a partial solid dielectric sphere. In both the conical feature and the spherical feature the base of the conical or spherical feature is smaller in area than the area inside the perimeter of the LED array. This is possible because of the change in index of refraction from air to a solid. In an embodiment, the conical feature is surrounded by the hollow glass sphere, which has the remote phosphor on its inside surface. The conical feature then ejects the light toward the remote phosphor. In the embodiment with the spherical ball at the end, the phosphor layer resides on the outside of the spherical dielectric. The phosphor layer also homogenizes the different wavelength light and ejects it in a spherical pattern similar to a traditional filament.

Part of the transfer optic may be exposed before it enters the sphere. The hollow glass sphere may then be mounted to an opaque shield which prevents light leakage from the sides of the transfer optic prior to its entry into the conical ejection feature. In the embodiment with the solid dielectric spherical emitter the sphere can be molded as one piece with the transfer optic. The opaque shield also is employed in this embodiment.

An exemplary system with equivalent output to a 60 W incandescent lamp consists of 9 light emitting diode chips, each approximately 1 mm by 1 mm in area. The preferred ratio of the number of blue chips to red chips is an integer. For example, for the case with 9 chips, there can be 4 blue chips and 4 red chips (and one empty space) or there can be 6 blue chips and 3 red chips. This preferred integer ratio makes it easier to dim the lamp using the quantum dimming approach of above-mentioned U.S. patent application Ser. No. 12/589,071. In the case where there are 4 blue and 4 red LEDs, there are four levels of output (25%, 50%, 75% and 100%), while in the case with 6 blue and 3 red LEDs, three levels can be obtained. This is possible without using pulse width modulation for either the blue or red sources. In the case where there is a non-integer ratio between the number of blue and red LEDs then the system still can work but one or more of the LEDs may require pulse width modulation in order to achieve a reasonable number of dimming levels without a color shift.

BRIEF DESCRIPTION OF THE DRAWINGS

The above and other aspects, features and advantages of the present invention will be apparent from the following more particular description thereof, presented in conjunction with the following drawings wherein.

DETAILED DESCRIPTION OF THE PREFERRED EMBODIMENTS

A better understanding of certain features and advantages of the present invention will be obtained by reference to the following detailed description and accompanying drawings, which set forth illustrative embodiments in which various principles of the invention are utilized.

Figure 1:
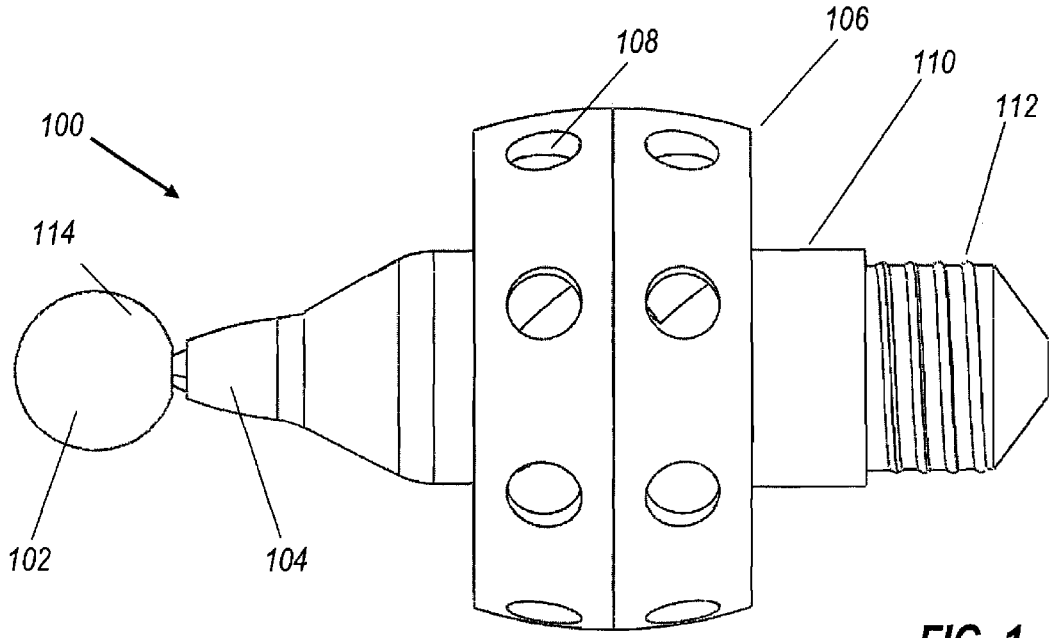
FIG. 1 is a side view of an embodiment of an LED light bulb system.

FIGS. 1 through 4 show embodiments of a dimmable LED lamp, indicated generally by the reference numbers 100 and 150. Referring initially to FIG. 1, lamp 100 comprises a dielectric sphere 102, an external shroud 104, a support ring 106 with holes 108, a body comprising an electronics compartment 110, and a screw-in base 112. The holes 108 enable air currents to flow within support ring 106 no matter at what orientation light bulb 100 is installed. On the outside of dielectric sphere 102 is a thin layer of phosphor 114. The phosphor typically is embedded inside a layer of optical grade epoxy, silicone or other suitable material known to those skilled in this art. Alternatively, the phosphor can be deposited on dielectric sphere 102 by a slurry process or some other process. A protective layer (not shown) is then formed over the phosphor.

Figure 2:
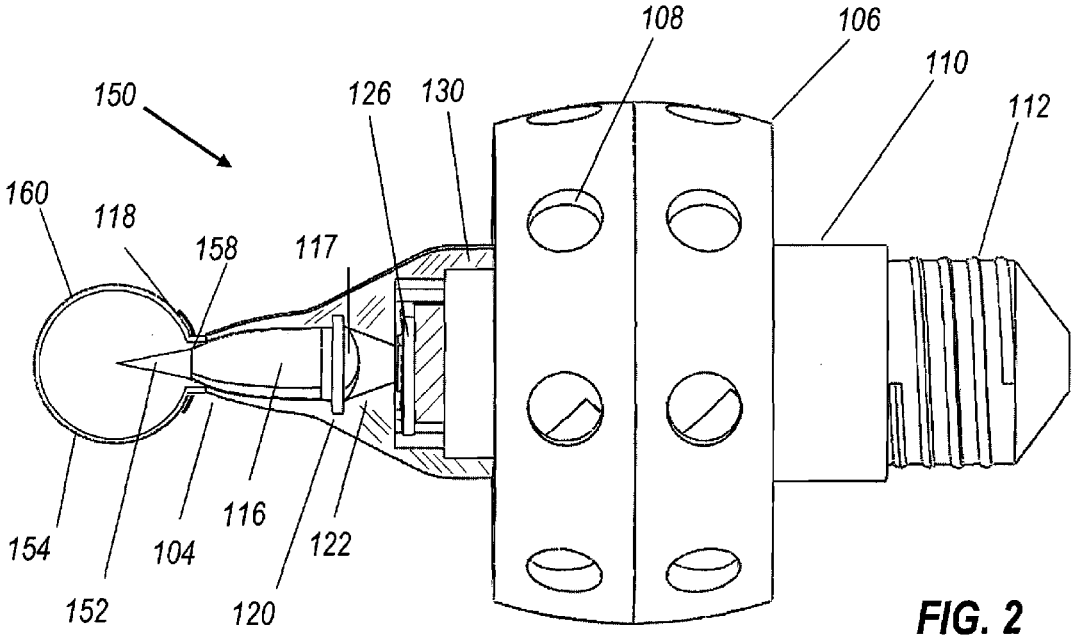
FIG. 2 is a partly cross-sectional side view of a second embodiment of a light bulb system.

FIG. 2 is a cutaway side view of a second embodiment of dimmable LED Lamp 150, in which features identical to those of FIG. 1 are identified with the same reference numbers, and the description of those features is not unnecessarily repeated. Lamp 150 has a conical ejector 152 and hollow dielectric sphere 154, further showing dielectric total internally reflecting concentrator 116 within shroud 104. Shroud 104 surrounds dielectric total internally reflecting concentrator 116. The interior surface of shroud 104 is highly reflective, to catch stray light The elements within shroud 104 are present in lamp 100 as well as in lamp 150, and the disclosure of lamp 100 includes elements of lamp 150 that are common to both lamps, that is to say, substantially all elements except features in and around balls 102, 154.

For clarity, a gap is shown between shroud 104 and sphere 102, 154. However, shroud 104 may touch sphere 102, 154 unless it would obstruct a part of the sphere through which light is intended to emerge. In FIG. 2, the hollow sphere 154 may be mounted on shroud 104 to minimize contact with the active surfaces of concentrator 116 and ejector 152. Concentrator 116 receives light at its convex wide end 117 and conveys the light to conical exit surface of conical ejector 152, from which light radiates onto an interior phosphor coating 160 on the interior surface of a hollow dielectric sphere 154.

Although the lamp 100 could operate with a solid dielectric sphere 102 having an external phosphor coating, practical considerations favor the adoption of the hollow sphere 154 of the preferred embodiment of FIG. 2.

Optional external reflector 118 is provided on part of the external surface of sphere 102, to conserve its light and prevent light from going towards the lower body of the lamp, where the light would be wasted. External reflector 118 is shown as separate lines for clarity but would actually usually be a very thin coating on the external surface of sphere 102. External reflector 118 may be omitted. Conical ejector 152 directs little light to the part of the sphere 154 immediately around the base of the ejector 152, so the amount of wasted light is relatively small. Also, in some uses the support ring 106 and cooling fins 128 (see FIGS. 3 and 4) may be considered a decorative feature that is desirably illuminated.

Conical ejector 152 in FIG. 2, or sphere 102 in FIG. 1, is mounted on the smaller, exit end of total internal reflection (TIR) concentrator 116, which is hidden within shroud 104. Shroud 104 is spaced from concentrator 116, to avoid interfering with the TIR at the surface of concentrator 116. A flange 120 holds concentrator 116 over the wide end of a reflective cone 122, from which concentrator 116 receives both directly radiated light from LED array 124 (best seen in FIG. 3) and light from LED array 124 reflected off the interior of cone 122. This array 124 is mounted on circuit board 126, which thermally communicates with external cylindrical surface 130 of body 110.

As shown in FIG. 2, hollow ball 154 is provided with a projecting flange 158 that is mounted on shroud 104, and an opening inside flange 158 for the ejector cone 152. This simplifies manufacture, because the conical reflector 122, TIR concentrator 116, and ejector cone 152 can be mounted to the LED 124 as one sub-assembly, and shroud 104 and ball 154 can then be mounted as a separate sub-assembly. An air-gap can then be left between the base of ejector cone 152 and hollow ball 154 to prevent light from bridging across. However, any light that leaks into the dielectric wall of hollow ball 154 through points of contact with ejector cone 152 is typically small in amount and typically escapes fairly easily into the phosphor coating 160, so it is not usually worth taking great measures to avoid all contact.

The wider, inlet end of concentrator 116 is convex, and acts as a convex lens 117, collecting and starting to concentrate the diverging light from the cone 122. The convex end 117 and the sidewalls of concentrator 116 have shapes tailored to work with cone 122 so that nearly all the light from cone 122 reaches conical ejector 152. There will, however, be some inevitable Fresnel reflectance from the convex surface 117 back into cone 122. Some of the light reflected from the convex surface 117 is retro-reflected by reflector 122 at angles at which it will enter surface 117 but will not stay within the sidewalls of concentrator 116. Instead this stray light escapes as leakage that could be highly noticeable. The interior surface of shroud 104 is mirrored, and has the functions of masking, intercepting, and returning this stray light.

Figure 3:
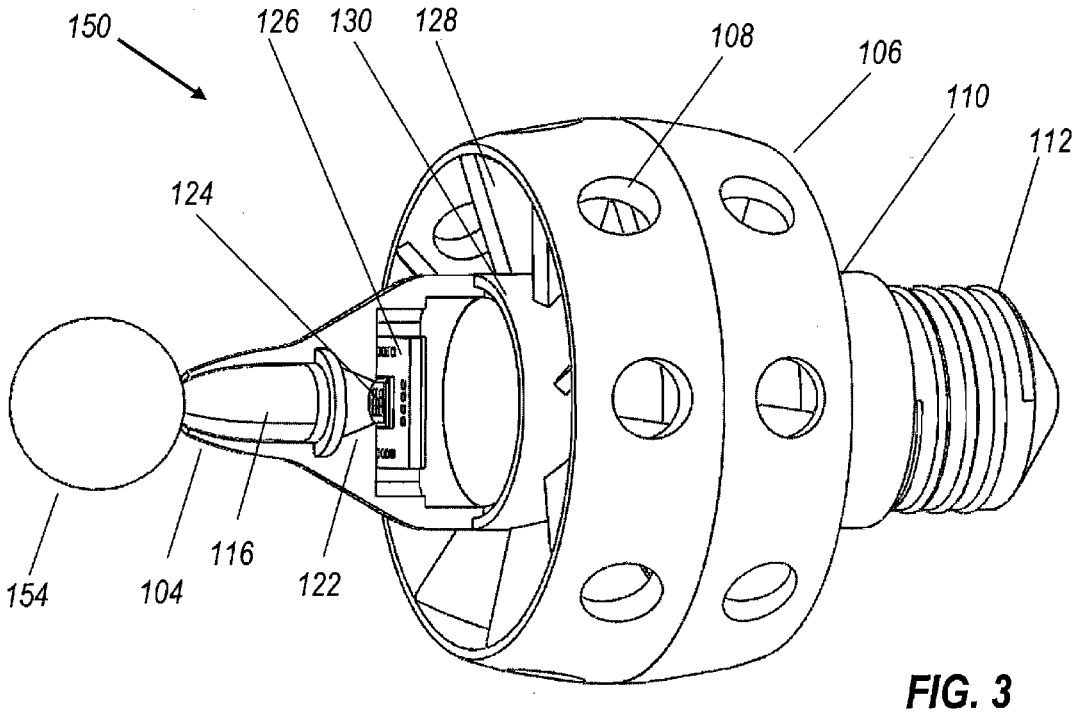
FIG. 3 is a perspective cutaway view of the light bulb system shown in FIG. 2.
Figure 4:
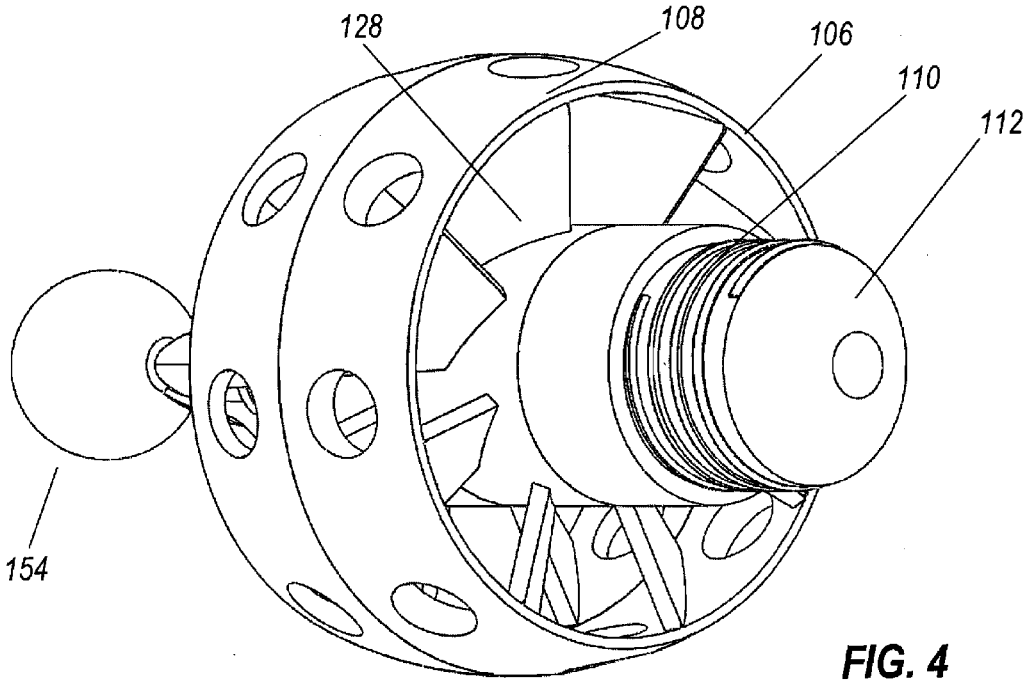
FIG. 4 is a perspective view of the light bulb system shown in FIG. 2 from a different viewpoint.

FIGS. 3 and 4 are further perspective views of dimmable LED lamp 150, showing in more detail helical heat-sink fins 128. FIGS. 3 and 4 also apply to dimmable LED lamp 100 of FIG. 1, because the differences between the two lamps are not shown in detail in FIGS. 3 and 4. Heat sink fins 128 extend radially between external cylindrical surface 130 of the lamp body and support ring 106. In conjunction with holes 108 on support ring 106, these fins are much more thermally effective than conventional heat sinks. Holes 108, together with the gaps (visible in FIG. 4D) between the halves (in an axial direction) of the helical fins 128, allow radial and circumferential, as well as axial, air flow. Helical fins 128 and holes 108 are especially beneficial when lamp 100 or 150 is mounted horizontally, or obliquely to the vertical, as they enable an effective upward convection current almost regardless of the orientation of lamp 100, 150. With presently available LED chips, it is desirable to prevent the red LED chips heating above a junction temperature of about 100° C., or an external temperature of about 70° to 80° C., because they tend to degrade if overheated, and their life is shortened. Blue LED chips are also affected by overheating, though they can typically tolerate slightly higher temperatures than red LEDs. Also, if the temperature of the dielectric TIR concentrator 116 is kept below about 70° C., then polymethyl methacrylate (PMMA) can be used. PMMA molds well, and has high transparency, but has a lower melting point than alternative materials. The size of cooling fins 108 and mounting ring 106 may be larger or smaller than shown, depending on the heat output and temperature tolerance of the components used in a specific lamp.

Figure 5:
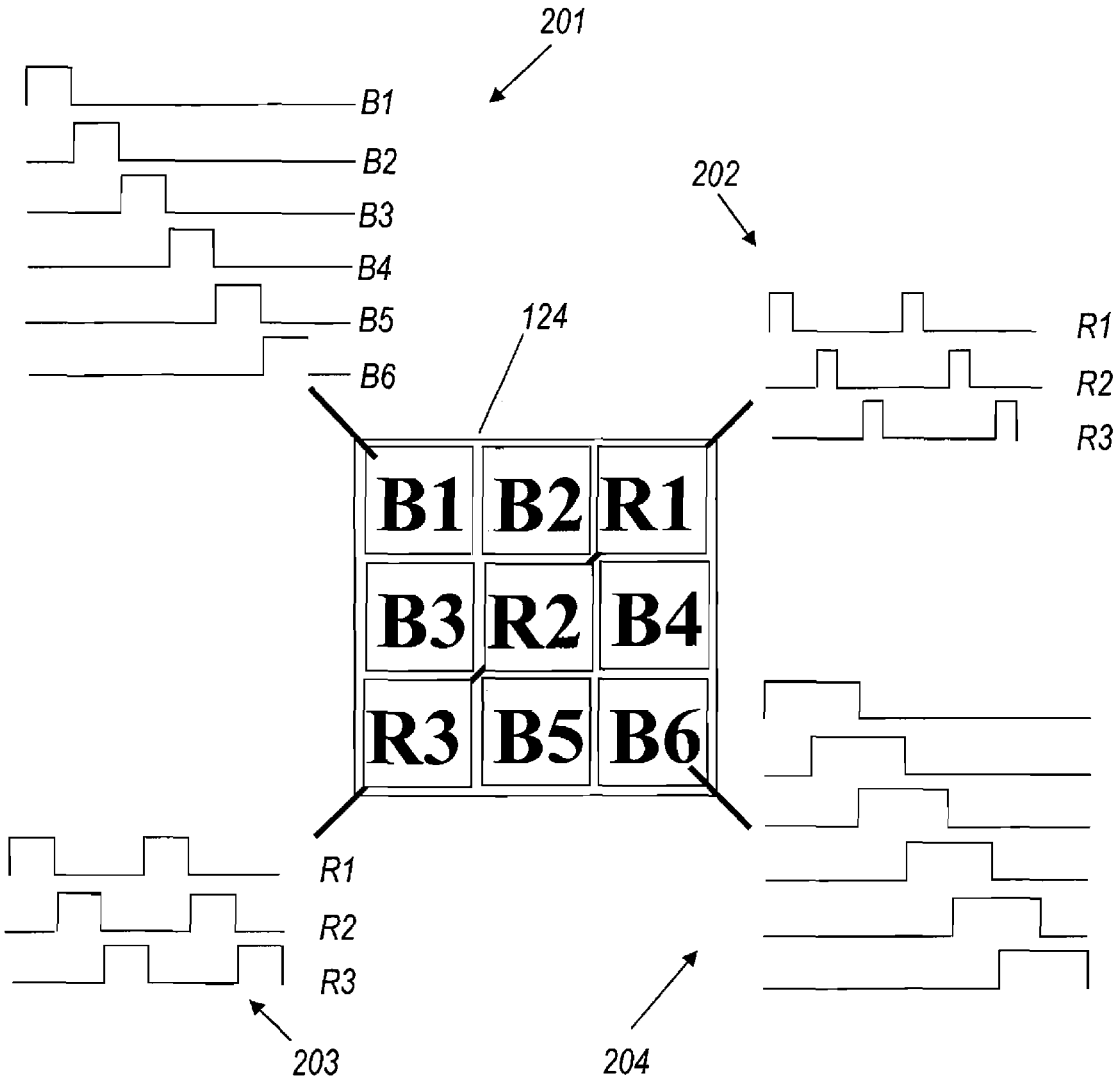
FIG. 5 shows exemplary quantum-dimming waveforms for a multi-chip LED light engine.

FIG. 5 shows examples of the operation of a quantum dimming scheme of dimmable LED lamp 100 of FIG. 1 or LED lamp 150 of FIG. 2. LED array 124 is shown with 9 LED chips, comprising six blue chips B1 through B6 and three red chips R1 through R3. The red chips are more efficient than a phosphor for producing red light, and when red chips R1 through R3 are provided, phosphor 160 of FIG. 1 or FIG. 2 can have a greenish or yellow spectrum lacking much red light. Separate intensity control of the red chips R1-R3 from the blue chips B1-B6 enables the color temperature of the array 124 to be adjusted separately from its overall luminosity. However, in a preferred embodiment each red LED chip is paired with two blue LED chips to form a triad, and each of the three triads is separately switched. In this approach, quantum dimming down to one third power can be achieved by turning on at any one time one triad set of LEDs (2 blue and 1 red). By turning on two sets, two thirds power can be obtained. Alternatively, a more complex quantum dimming approach, or a combined quantum dimming and PWM approach, can be used to achieve finer control of dimming. For example, if it is required to dim the lamp to one sixth power, then the red LEDs can be pulse width modulated so that when one blue LED is on, the red chip is on for one half the time of the blue. As long as a 2 to 1 flux ratio of the blue to red is maintained when averaged over a short time period (any fluctuations must be too brief to be perceived by the eye) then the light source will appear to have a constant color temperature over all dimmed settings. Using 6 blue chips and 3 red chips, six distinct quantum dimming settings can be achieved where the red chip is sometimes pulse width modulated and other times is not. This is illustrated in FIG. 5.

On the upper left of FIG. 5 is shown group 201 of current waveforms, comprising the six current inputs, labeled B1 through B6 for the blue chips shown within array 124. This is the lowest of six blue-luminosity levels of the quantum dimming method without pulse-width modulating the blue chips. Each blue chip takes its turn at running at full current for its share (one sixth) of a cycle. The observer perceives a steady light equal in intensity to a single blue LED chip shining continuously, with at most a very slight flicker at the switching points.

On the upper right of FIG. 5 is shown group 202 of current waveforms, comprising the three current inputs, labeled R1 through R3 for the red chips within array 124. This is the lowest of six red-luminosity levels, corresponding to the blue-luminosity level of waveform group 201 of the quantum dimming method. Each red LED is on for half the time of one of the blue chips. Each red LED corresponds to two blue LEDs, so two of the cycles of the red LEDs in group 202 are shown coincident with the single cycle of group 201. In group 202, there is one red LED on for half the time, so there is effectively a 50% pulse-width modulated (PWM) red light, with a PWM cycle time of ⅓ of the overall red group 202 cycle time or ⅙ of the overall blue group 201 cycle time. In that configuration, the PWM cycle time must be too short for the user to notice a flicker, even though the overall group 202 cycle time is longer.

On the lower left of FIG. 5 is shown group 203 of current waveforms, comprising the three current inputs R1 through R3 for the red chips within array 124. Each red chip takes its turn running at full current. This is the second of six dimming levels (one third dimming) using quantum dimming. Two of its cycles are shown coincident with the single cycle of group 204.

On the lower right of FIG. 5 is shown group 204 of current waveforms, comprising the six current inputs B1 through B6 for the blue chips within array 124. This coincides with the reds in group 203 to produce the second of six blue-luminosity levels of the quantum dimming method without PWM. One of its cycles is shown coincident with the two cycles of group 203. At any one time two of the blue chips are on and four are off. As shown in group 204, each blue LED is on for two successive sixths of the group cycle, but alternatively each blue LED may be on for two separate sixths of the group cycle.

In the first example 201, 202 a combination of quantum dimming for the blue chips with pulse width modulation for the red chips is used, whereas in the second example 203, 204 only quantum dimming is needed. Further control of chip luminosity is obtained through modifying the level of current for activated LEDs either up or down, although overdriving can accelerate chip ageing. By adjusting the current of each LED and by incorporating pulse width modulation for at least the reds, a wide range of color temperatures is possible for every dimming level.

Various blue and red chips may require a different ratio than the 6:3 shown in FIG. 5, for example 5:4 or 7:2. The 6:3 ratio is shown because the blue and red waveforms of individual LEDs synchronize explicitly. A more complex ratio usually results in patterns in which the red LEDs are switched at different times from the blue LEDs, and/or in which PWM of the LEDs of at least one color is required at most or all dimming levels.

Various modifications of the described embodiments are possible. For example the ejector 152 has been described as a cone, and the emitter 102 or 154 has been described as a sphere. Those shapes are simple to design, simple to manufacture, and provide in operation a good approximation to the light output distribution of a conventional incandescent bulb (approximately spherical except for a shadow around the base 112). However, the conical ejector 152 need not be exactly conical, the sphere need not be exactly spherical, and other shapes entirely may be substituted. The skilled person will understand how to select a shape that will provide a desired light output distribution, and even shapes that provide a less than optimal light distribution may be selected for other reasons, including the appearance of the lamp 100, 150 itself.

The cone 122 between the LED array 124 and the lens 117 may be replaced by a differently shaped collimator. However, the cone 122 is simple to fabricate, because it can be rolled from a piece of flat reflective material, and is adequate for the purpose, when assisted by the lens 117, of ensuring that almost all the light from the LED chips 124 enters the concentrator 116 within the acceptance angle of the concentrator.

Although the lamp 100, 150 is shown with an Edison screw fitting 112 that is standard for mounting and power supply in the USA, of course a different form of fitting may be substituted. That may be done for compatibility with other standards (at least three sizes of Edison screw fitting are standard in the USA alone) or with the standards of other places, or for incompatibility with standards, to compel or prevent fitting of the lamp 100, 150 in selected receptacles.

Although FIGS. 1 through 4 show various modifications of the described embodiment, the skilled reader will understand how to select and combine among those modifications.

The preceding description of the presently contemplated best mode of practicing the invention is not to be taken in a limiting sense, but is made merely for the purpose of describing the general principles of the invention. The full scope of the invention should be determined with reference to the Claims.

We claim:

1. A dimmable lamp comprising:

an array of adjacent light-emitting elements, a reflector surrounding said array and widening away from the array to an exit aperture, a dielectric total internally reflecting concentrator with a convex entrance aperture coincident with said exit aperture of said reflector, said concentrator having an exit aperture narrower than said convex entrance aperture situated at an opposite end of said concentrator from said convex entrance aperture, said exit aperture of said concentrator in optical communication with a ball having a phosphor coating that converts part of the light from said light emitting elements to a different wavelength, and transmits part of the light from said light emitting elements, the luminosity of said array of light-emitting elements controlled by a quantum dimmer, wherein the heat from said array and the phosphor is cooled by a helical fin thermal management system, wherein said ball is a hollow dielectric sphere, said exit aperture of said concentrator comprising a dielectric cone with its base coincident with the narrow end of the sidewalls of said concentrator, said dielectric cone surrounded by said hollow dielectric sphere, the tip of said cone near the center of said dielectric sphere.

2. The lamp of claim 1, wherein the light-emitting elements are light-emitting diodes.

3. The lamp of claim 1, wherein the reflector is conical.

4. The lamp of claim 1, wherein said phosphor coating is on an interior surface of said hollow sphere.

5. The lamp of claim 1, wherein the phosphor-coated ball is operative to homogenize the converted part of the light and the transmitted part of the light.

6. The lamp of claim 1, wherein the light-emitting elements comprise elements emitting blue light and elements emitting red light, and wherein the phosphor converts part of the blue light to yellow or green light.

7. A lamp comprising:

a light-emitter, a reflector surrounding said light emitter and widening away from the light-emitter to an exit aperture, a dielectric total internally reflecting concentrator with a convex entrance aperture coincident with said exit aperture of said reflector, said concentrator having an exit aperture narrower than said convex entrance aperture situated at an opposite end of said concentrator from said convex entrance aperture, said exit aperture of said concentrator in optical communication with a dielectric ejector with its base coincident with the narrow end of the sidewalls of said concentrator;

a hollow ball having a phosphor coating that converts part of the light from said light emitter to a different wavelength, and transmits part of the light from said light emitter, wherein said hollow ball is a dielectric sphere surrounding said ejector, said ejector having a tip near the center of said dielectric sphere.

8. The lamp of claim 7, wherein the light-emitter comprises an array of light-emitting diodes, the luminosity of said array of light-emitting elements controlled by a quantum dimmer.

9. The lamp of claim 7, wherein the reflector is conical.

10. The lamp of claim 7, wherein the ejector is conical.

11. The lamp of claim 7, wherein the heat from said light emitter and the phosphor is cooled by a helical fin thermal management system.

12. The lamp of claim 7, wherein said phosphor coating is on an interior surface of said hollow ball.

13. The lamp of claim 7, wherein the phosphor-coated ball is operative to homogenize the converted part of the light and the transmitted part of the light.

14. The lamp of claim 7, wherein the light-emitter comprises elements emitting blue light and elements emitting red light, and wherein the phosphor converts part of the blue light to yellow or green light.

15. A dimmable LED lamp comprising:

an array of multiple adjacent light-emitting diodes;

a conical reflector surrounding said array and expanding from the array into an exit aperture;

a dielectric total internally reflecting concentrator with its convex entrance aperture coincident with the said exit aperture of said conical reflector;

said concentrator having its own exit aperture situated at the opposite end from said convex entrance aperture;

said exit aperture of said concentrator comprising a dielectric ejector with its base coincident with the narrow end of the sidewalls of said concentrator;

said dielectric ejector surrounded by a hollow dielectric ball with a phosphor coating on its interior surface, said ejector having a tip near the center of said dielectric ball;

the luminosity of said LED array controlled by a quantum dimmer;

wherein the heat from said LED array and the phosphor is cooled by a helical fin thermal management system.

16. The lamp of claim 15, wherein the ejector is a cone.

17. The lamp of claim 15, wherein the ball is a sphere.

* * * * *